United States Patent [19]

Seiden

[11] 4,023,131

[45] May 10, 1977

[54] ELECTRIC CIRCUIT BREAKER WITH AMBIENT TEMPERATURE COMPENSATING MEANS

[75] Inventor: Frederick C. Seiden, Holmes Beach, Fla.

[73] Assignee: Workman Electronic Products, Inc., Sarasota, Fla.

[22] Filed: Feb. 26, 1976

[21] Appl. No.: 661,568

[52] U.S. Cl. ..... 337/67; 337/72; 337/78; 337/101

[51] Int. Cl.[2] ..... H01H 71/16

[58] Field of Search ..... 337/39, 40, 67, 72, 337/75, 78, 81, 101, 128–130, 349, 359

[56] References Cited

UNITED STATES PATENTS

| | | | |
|---|---|---|---|
| 2,757,258 | 7/1956 | Jorgensen | 337/101 |
| 3,038,047 | 6/1962 | Marquis | 337/101 |
| 3,234,348 | 2/1966 | Desio | 337/101 |

FOREIGN PATENTS OR APPLICATIONS

| | | | |
|---|---|---|---|
| 845,309 | 8/1970 | United Kingdom | 337/75 |

*Primary Examiner*—William H. Beha, Jr.
*Attorney, Agent, or Firm*—J. Gibson Semmes

[57] ABSTRACT

Electric circuit breaker alternately providing overcurrent and/or over temperature protection by means of temperature responsive bimetal elements, whereby an increase in pressure as between electrical contacts is effected as the temperature may be increased up to the point of break, resulting in improved contact life and more effective contact when the device is subjected to external vibration.

8 Claims, 4 Drawing Figures

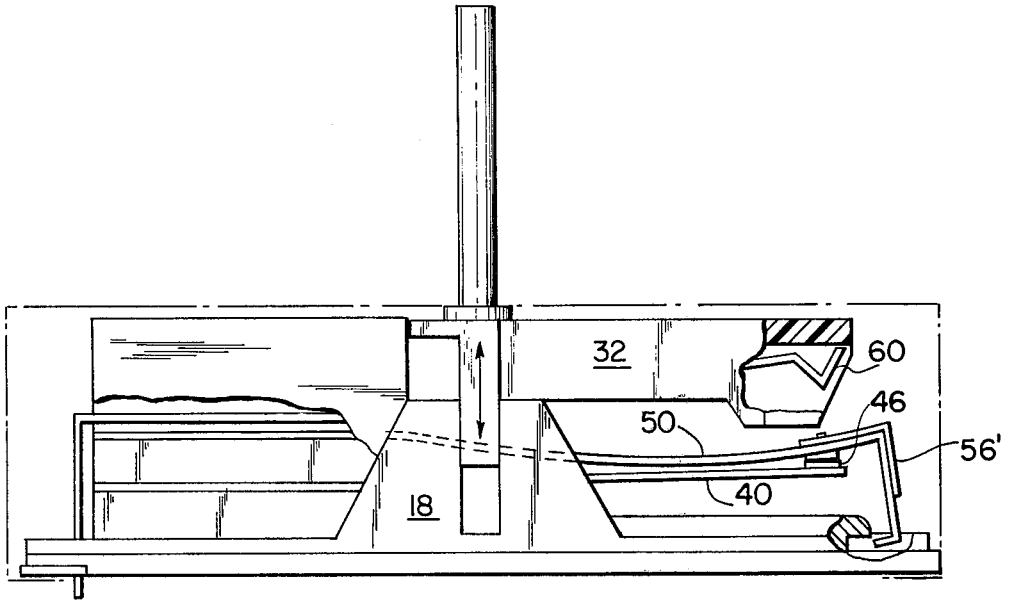
FIG. 2
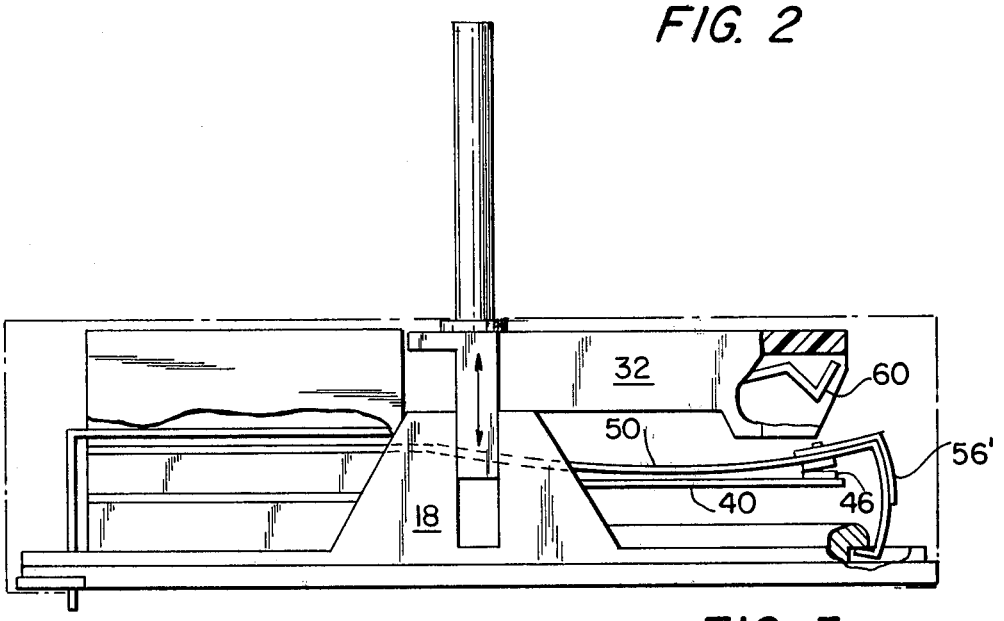
FIG. 3
FIG. 4
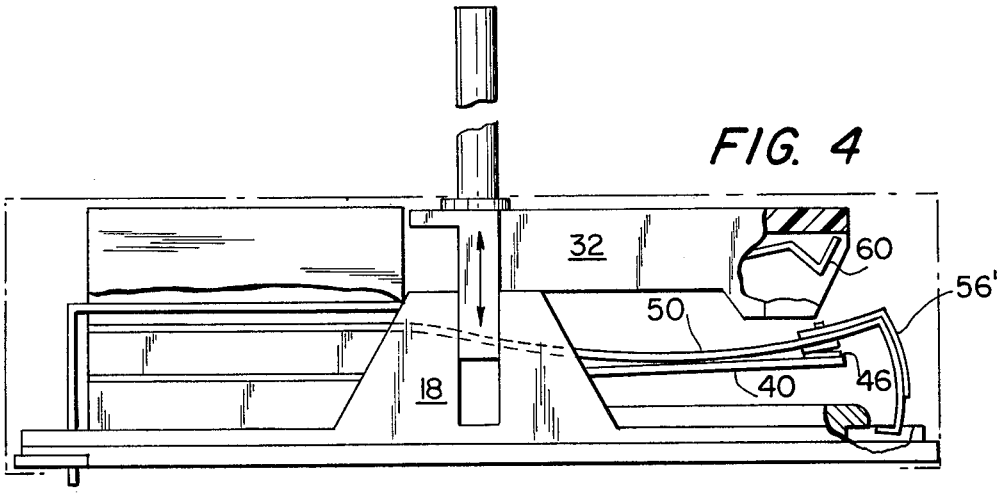

ELECTRIC CIRCUIT BREAKER WITH AMBIENT TEMPERATURE COMPENSATING MEANS

BACKGROUND OF THE INVENTION

In general, the prior art comprises circuit breakers in which the contact pressure between coactive electrical contact elements, decreases when temperature may be increased. The disadvantages hereof comprise contact chattering and/or excessive arcing. In much of the prior art, there is attempt to create effective latching at the points of contact-reference Marquis U.S. Pat. No. 3,038,047 dated June 5, 1962, and Desio U.S. Pat. No. 3,234,348 dated Feb. 8, 1966. The circuit breaker of the instant invention, on the other hand, does not involve latching one bimetal to another nor the latching of contacts together. Among the significant patents in this area is the patent to Widmer U.S. Pat. No. 2,915,618, dated Dec. 1, 1959, a thermal time delay switch, directed however to the provision for two bimetal elements extending generally in the same direction in spaced relation to each other together with a heater element, the respective bimetal elements being influenced so as to warp in the same direction, etc.

Other art of interest includes the following, distinguishable on the same and related grounds. Frey et al. U.S. Pat. No. 2,910,561, dated Oct. 27, 1959; Persons U.S. Pat. No. 2,159,342, dated May 23, 1939; Dafler U.S. Pat. No. 3,718,162 dated Feb. 27, 1973; and Brown Pat. No. 3,702,454 dated Nov. 7, 1972.

BRIEF DESCRIPTION OF THE DRAWINGS

FIG. 2 is a view in side elevation of the invention portions thereof being broken away, said figure showing deflection of the actuator element which is due to self-heat only.

FIG. 3 is also a view in side elevation of the invention, a portion thereof being broken away, to show deflection of both acutator and associated latch, the deflection being due to ambient heat only.

FIG. 4 is likewise a view in side elevation, a portion thereof being broken away, showing deflection of the respective actuator and latch tab, the deflection being due to both self-heat and ambient heat.

DESCRIPTION OF THE PRERERRED EMBODIMENTS

Figure 1:
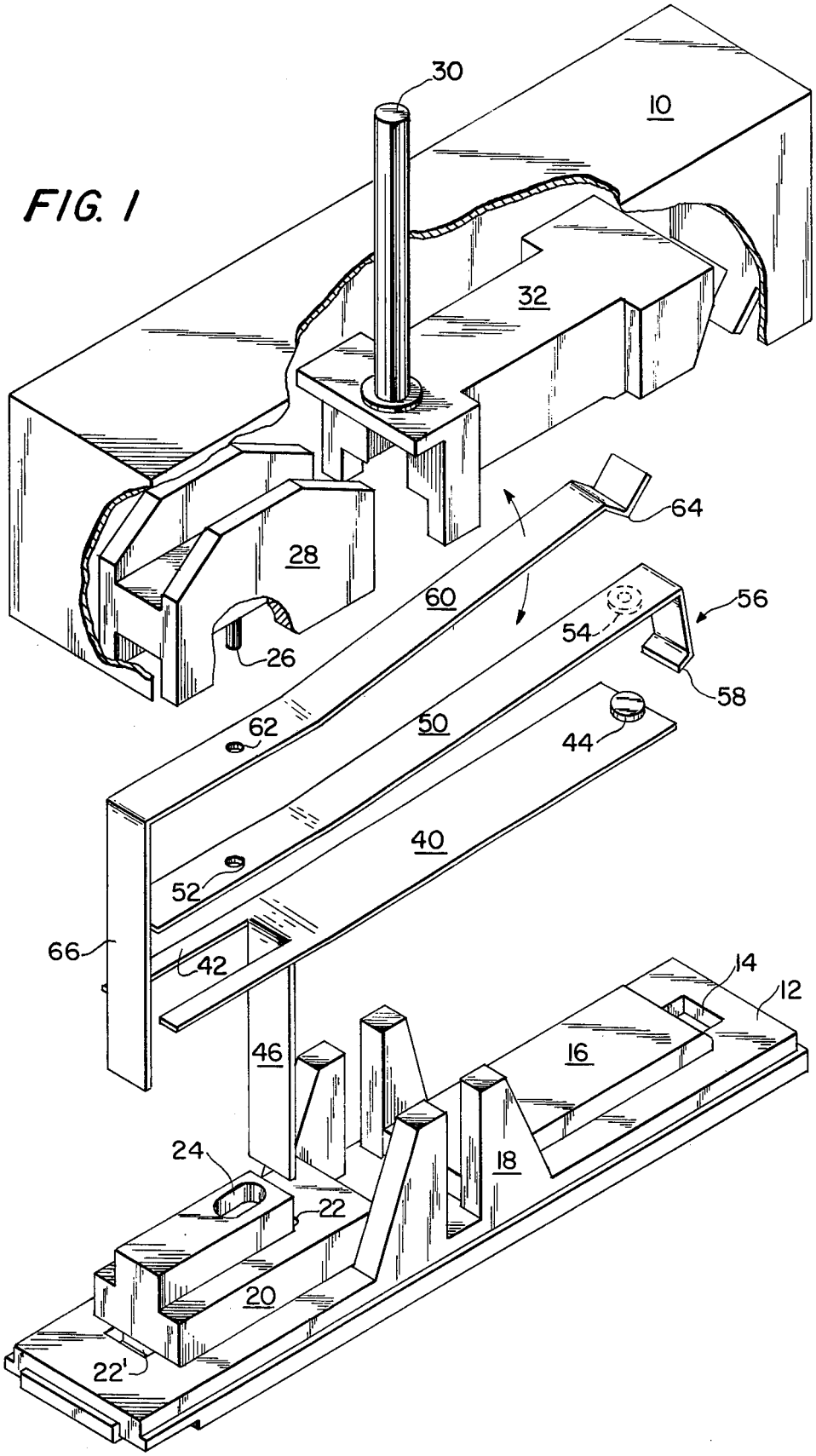
FIG. 1 is a view in perspective of invention, showing the coactive elements in spaced apart, preassembly array.

The circuit breaker of the invention is essentially a device for providing overcurrent and/or over-temperature protection, using temperature responsive elements which are adapted as acutator with latch tab to coact upon the application of heat to effect a tighter latch and more efficient make and break electrical contact.

The essential elements are set forth in FIG. 1, wherein the housing 10 is adapted to confine a base 12, said base 12 having at one end a well 14, superposed in part by a latching platform 16, said platform 16, the uprights 18 being integral in construction therewith. Uprights 18 are adapted to secure the resetting combination button return 30-32 in slidable relation thereto for effecting electrical contact initially, as will hereinafter be described. At the opposite end of the base 12 is a mounting block 20, said mounting block 20 having right hand and left hand apertures 22 and 22', respectively adapted to the seating of the vertical extensions 46 and 66 respectively of the conductor contact arm 40 and compression or button return spring 60, which said spring is bent at 64 to form an actuator detent. As will be apparent, the actuator conductor arm 50 and contact conductor arm 40 each are provided with appropriate contacts 44 and 54, said contacts being disposed along the respective lengths an appropriate distance to accommodate make-break contact as will be hereinafter described. Arm 40 seats at its left hand end, about the block 20, extensions 42 engaging sides of the block. The set pin 26 in the block 28 may be appropriately forced downwardly through the corresponding apertures 52 and 62 of the spring and actuator arms and into the oblong clearance opening seat 24. The spring and actuator arms may be shifted laterally, relative to the contact arm 44 so as to strengthen or weaken the effect of the latching extension 56 and 58, forming a latching tab, relative to the corresponding aperture 14 and latch 16 of the base 12. With specific reference to the actuator conductor 50, it is preferentially composed of a bimetal in which the low expansion component thereof is on top. The latching extension thereof, comprising the elements 56 and 58 likewise are formed of a bimetal, having high expansion characteristics on the exterior or right hand portion thereof, reference FIG. 1. A compensating tab 56', reference FIGS. 2–4 may optionally be adapted to the latching extension.

Referring to FIG. 2, as the bimetal element 50, comprising the actuator conductor arm may be self-heated, due to conduction, it bows or deflects in a concave direction, causing the latch tab 58 to disengage from the corresponding latch portion of the element 16. The latch having been previously set, springs upward and is thus disengaged and the contacts 44–54 opened. Such actuator deflection is due to induced self-heat, caused in the conduction of excessive current only.

Referring to FIG. 3, with respect to the application of deflection characeteristics which may be due to high ambient heat of 130° to 150° F., per se, the conductor arm 50 again bows or deflects in a concave direction but as the compensation tab is also subject to this ambient temperature is deflects in the opposite direction. Now, the latching effect is not changed, since the compensation tab deflection negates the effect of deflection of the main portion of the actuator. The bimetal used in the compensation tab can have a higher or lower deflection rate compared to the main portion of the actuator, thus the degree of compensation can be controlled.

The invention, as illustrated in FIG. 4, encompasses forming the latch portion 56–58 of the actuator contactor arm of a bimetal which will operate in the reverse direction relative to the actuator, when 150° F. to 200° F. of ambient is applied to the combination actuator 50 and latch 56. The latch will deflect reversely, to the deflection of the actuator which is influenced by both self-heat and ambient temperatures of the order of 250° F. and above. The latch portion 56–58 will receive ambient heat only and will deflect reversely, in effect enhancing the precise unlatching effect by increasing contact pressure to point of break.

A further modification of the invention is shown in FIG. 4, wherein the actuator 50, having heat responsive low expansion characteristic, carries a high expansion latch compensation tab 56'. As previously described, the latch 56 and the actuator are so constructed that a substantial increase in ambient heat will cause deflection of the respective elements in a reverse direction, thus deflection in the latch and compensation tab is such as to eliminate the effect of the deflection in the acutator. As stated, the latching portion 56 from the contact rivet to the latch end may not be heated as a result of current flow, but is affected only by ambient heat. Therefore, the materials used in the compensation tab 56' and latch 56 are such as to provide wide range of compensation at from 10% to 100% as required.

By way of modification, adjustment of the respective spring 60, actuator 50 through movement of the aligning pin 26 in the oblong aperature 24, results in an operational strength in the engagement at the latch point, which may be thus varied, resluting in a range of amp ratings when one uses the same bimetal elements of actuator and latch.

I claim:

1. Electric circuit breaker providing overcurrent and/or excessive ambient temperature protection comprising:

A. a base member having a latching platform thereon;

B. flexible actuator and conductor contact arms, said arms being set upon the platform in spaced apart relation to each other, the actuator contact arm having a latching extension, engageable with the latching platform; the actuator arm and latching extension each being comprised of bimetals, each having distinguishing characteristics over the other in that the latching extension is unaffected by current flow, whereas the actuator extension is affected by current flow and ambient temperature change;

C. actuator arm compression return means, operatively disposed with respect to the said actuator contact arm, whereby an increase in pressure between electrical contacts is effected as the temperature may be increased up to the point of break, resulting in improved contact life and more effective contact as the circuit breaker may be subjected to external vibrations.

2. The electric circuit breaker of claim 1 wherein the said actuator arm and its latching extension are constructed to respond in opposite deflection characteristic relative to each other upon increase in ambient temperature.

3. The electric circuit breaker of claim 1 wherein the deflection rate characteristic of the latching extension, relative to the actuator arm is variable for compensation control.

4. The electric circuit breaker of claim 2 wherein the actuator arm is laterally adjustable, relative to the conductor contact arm, whereby the latching effect thereof may be adjusted.

5. The electric circuit breaker of claim 2 wherein the said actuator arm has a heat-responsive low expansion characteristic and the said latch extension carries a compensation tab having a heat-responsive of relative high expansion characteristic.

6. The electric circuit breaker of claim 3 wherein the said actuator arm has a heat-responsive low expansion characteristic and the said latch extension carries a compensation tab having a heat-responsive of relative high expansion characteristic.

7. The electric circuit breaker of claim 4 wherein the said actuator arm has a heat-responsive low expansion characteristic and the said latch extension carries a compensation tab having a heat-responsive of relative high expansion characteristic.

8. The electric circuit breaker of claim 4 wherein the compression return means is laterally adjustable relative to the actuator arm.

* * * * *